US012473618B2

(12) United States Patent
Natori et al.

(10) Patent No.: US 12,473,618 B2
(45) Date of Patent: Nov. 18, 2025

(54) NON-ORIENTED ELECTRICAL STEEL SHEET AND MANUFACTURING METHOD THEREFOR

(71) Applicant: NIPPON STEEL CORPORATION, Tokyo (JP)

(72) Inventors: Yoshiaki Natori, Tokyo (JP); Hiroyoshi Yashiki, Tokyo (JP); Minako Fukuchi, Tokyo (JP); Kazutoshi Takeda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 18/283,152

(22) PCT Filed: Mar. 30, 2022

(86) PCT No.: PCT/JP2022/016029
§ 371 (c)(1),
(2) Date: Sep. 20, 2023

(87) PCT Pub. No.: WO2022/210890
PCT Pub. Date: Oct. 6, 2022

(65) Prior Publication Data

US 2024/0035131 A1 Feb. 1, 2024

(30) Foreign Application Priority Data

Mar. 31, 2021 (JP) ..... 2021-061872

(51) Int. Cl.

| | |
|---|---|
| ***C22C 38/02*** | (2006.01) |
| ***C21D 8/02*** | (2006.01) |
| ***C22C 38/00*** | (2006.01) |
| ***C22C 38/04*** | (2006.01) |

(52) U.S. Cl.
CPC ..... *C22C 38/02* (2013.01); *C21D 8/0205* (2013.01); *C21D 8/0226* (2013.01); *C21D 8/0236* (2013.01); *C21D 8/0273* (2013.01); *C22C 38/002* (2013.01); *C22C 38/04* (2013.01)

(58) Field of Classification Search
CPC .... C21D 6/008; C21D 8/1222; C21D 8/1233; C21D 8/1238; C21D 8/1272; C22C 38/001; C22C 38/002; C22C 38/004; C22C 38/008; C22C 38/02; C22C 38/04; C22C 38/06; C22C 38/08; C22C 38/10; C22C 38/16; C22C 38/60; H01F 1/14775; H01F 3/02; Y02P 10/20
See application file for complete search history.

(56) References Cited

U.S. PATENT DOCUMENTS

| | | | | |
|---|---|---|---|---|
| 2021/0371948 | A1* | 12/2021 | Zaizen | C22C 38/002 |
| 2022/0018004 | A1 | 1/2022 | Lee et al. | |
| 2022/0049323 | A1* | 2/2022 | Oda | C22C 38/28 |
| 2022/0064751 | A1 | 3/2022 | Okubo et al. | |
| 2022/0186330 | A1 | 6/2022 | Murakawa et al. | |
| 2022/0359108 | A1* | 11/2022 | Tanaka | H01F 3/02 |

FOREIGN PATENT DOCUMENTS

| | | | | |
|---|---|---|---|---|
| EP | 4 400 610 | A1 | 7/2024 | |
| JP | 2-263920 | A | 10/1990 | |
| JP | 3-219020 | A | 9/1991 | |
| JP | 2005-330527 | A1 | 12/2005 | |
| JP | 2019-178373 | A | 10/2019 | |
| JP | 2020-139198 | A | 9/2020 | |
| TW | 202024355 | A | 7/2020 | |
| TW | 202028480 | A | 8/2020 | |
| WO | WO-2020090160 | A1 * | 5/2020 | B21B 1/22 |
| WO | WO 2020/111783 | A2 | 6/2020 | |
| WO | WO 2020/153387 | A1 | 7/2020 | |
| WO | WO-2020137500 | A1 * | 7/2020 | C21D 1/26 |
| WO | WO 2020/166718 | A1 | 8/2020 | |

OTHER PUBLICATIONS

NPL: on-line translation of WO-2020137500-A1, Jul. 2020 (Year: 2020).*

* cited by examiner

*Primary Examiner* — Jie Yang
(74) *Attorney, Agent, or Firm* — Birch, Stewart, Kolasch & Birch, LLP

(57) ABSTRACT

This non-oriented electrical steel sheet has a predetermined chemical composition, and in which the tensile strength is 580 MPa or more, the average grain size of a recrystallization part of base iron is 50 μm or less, and in inclusions having an equivalent circle diameter of 1 μm or more and an S content of 5 mass % or more contained in base iron, the number of inclusions having a Mg content of more than 5 mass % and a Mn content of 5 mass % or more is 5 times or more the number of inclusions having a Mg content of 5 mass % or less and a Mn content of 5 mass % or more.

7 Claims, No Drawings

NON-ORIENTED ELECTRICAL STEEL SHEET AND MANUFACTURING METHOD THEREFOR

TECHNICAL FIELD

The present invention relates to a non-oriented electrical steel sheet and a manufacturing method therefor. Priority is claimed on Japanese Patent Application No. 2021-61872, filed Mar. 31, 2021, the content of which is incorporated herein by reference.

BACKGROUND ART

In recent years, due to worldwide enhanced energy saving for electrical instruments, higher performance properties have been required for non-oriented electrical steel sheets used as materials for motors. In particular, there is a strong need to reduce iron loss, and low iron loss can be achieved by increasing specific resistance by increasing the Si or Al content, and increasing the crystal grain diameter.

Patent Document 1 discloses a non-oriented electrical steel sheet with a lower iron loss, which addresses the problem of nitriding that becomes apparent in a steel sheet in which sulfides are detoxified and grain growth is improved.

CITATION LIST

Patent Document

[Patent Document 1]
Japanese Unexamined Patent Application, First Publication No. 2005-330527

SUMMARY OF THE INVENTION

Problems to be Solved by the Invention

The use of motors for applications such as drive motors of hybrid automobiles is in an environment with stress change caused by changes in rotation speed according to an acceleration/deceleration operation, vehicle body vibration, and magnet vibration in magnet insertion holes. Therefore, in addition to high strength that can has an application during high-speed rotation and in stress concentration parts, a fatigue property under repeated stress, that is, fatigue strength, is also required.

However, in the non-oriented electrical steel sheet whose tensile strength is increased to 580 MPa or more, the fatigue strength appropriate for strength may not be obtained. In the present invention, an object is to provide a non-oriented electrical steel sheet having a tensile strength of 580 MPa or more and having excellent fatigue strength.

Means for Solving the Problem

The inventors conducted extensive studies regarding the fatigue strength of non-oriented electrical steel sheets. As a result, it was found that, in an electrical steel sheet with low fatigue strength, soft MnS deforms, and becomes a starting point for cracks. In addition, it was found that, in an electrical steel sheet with high fatigue strength, the amount of MnS in inclusions is relatively small.

In addition, as a result of additional intensive studies, it was found that fatigue strength is improved by converting sulfides in inclusions into harder inclusions containing Mg.

The present invention has been further studied based on the above findings, and the gist thereof is as follows.

(1) A non-oriented electrical steel sheet according to one embodiment of the present invention having a chemical composition containing, in mass %, Si: 2.5 to 4.5%, sol. Al: 0 to 2.0%, Mn: 0.1 to 3.5%, C: 0 to 0.0030%, P: 0 to 0.10%, S: 0 to 0.0030%, N: 0 to 0.050%, O: 0 to 0.050%, Mg: 0.0003 to 0.0050%, Ti: 0 to 0.0030%, V: 0 to 0.10%, Sb: 0 to 0.10%, Nd: 0 to 0.10%, Bi: 0 to 0.10%, W: 0 to 0.10%, Nb: 0 to 0.10%, Y: 0 to 0.10%, and one or more selected from the group consisting of Ni: 0 to 0.5%, Cr: 0 to 0.5%, Cu: 0 to 0.5%, Sn: 0 to 0.2%, La: 0 to 0.0050%, and, Ce: 0 to 0.0050%, with the remainder of Fe and impurities, in which a tensile strength is 580 MPa or more, an average grain size of a recrystallization part of base iron is 50 μm or less, and in inclusions having an equivalent circle diameter of 1 μm or more and an S content of 5 mass % or more contained in base iron, the number of inclusions having a Mg content of more than 5 mass % and a Mn content of 5 mass % or more is 5 times or more the number of inclusions having a Mg content of 5 mass % or less and a Mn content of 5 mass % or more.

(2) In the non-oriented electrical steel sheet according to (1), the number density of inclusions having an equivalent circle diameter of 5 μm or more may be less than 1.0 piece/mm$^2$.

(3) In the non-oriented electrical steel sheet according to (1), the sheet thickness may be less than 0.30 mm.

(4) A method for manufacturing a non-oriented electrical steel sheet according to another embodiment of the present invention is a method for manufacturing the non-oriented electrical steel sheet according to (1), including manufacturing a steel slab by casting; heating the steel slab; hot rolling the heated steel slab to obtain a hot-rolled steel sheet; coiling the hot-rolled steel sheet; cold rolling the hot-rolled steel sheet to obtain a cold-rolled steel sheet; and final annealing the cold-rolled steel sheet to obtain a non-oriented electrical steel sheet, in which, in the casting, a cooling rate at 1,300° C. to 1,200° C. is set to 50° C./s or slower, in the heating of the steel slab, a holding time at a center temperature of 1,100° C. or higher is set to be shorter than 2 hours (excluding 0), in the coiling, a coiling temperature of the hot-rolled steel sheet is set to 700° C. or higher, and in the final annealing, the maximum temperature is set to 700 to 900° C.

Effects of the Invention

According to the present invention, it is possible to obtain a non-oriented electrical steel sheet having a tensile strength of 580 MPa or more and also excellent fatigue strength.

Embodiment(s) for Implementing the Invention

Hereinafter, embodiments of the present invention will be described in detail.

In the non-oriented electrical steel sheet according to one embodiment of the present invention, fatigue strength is improved by converting sulfides in inclusions in base iron into harder inclusions containing Mg. In the present invention, harder inclusions containing Mg are defined as follows. In element concentration analysis by Energy Dispersive X-ray Spectrometry (hereinafter referred to as "EDS"), when all detected elements (excluding C) are quantified, inclusions in which more than 5 mass % of Mg is detected and 5 mass % or more of S is detected are defined as "harder inclusions containing Mg." In the present invention, among the harder inclusions containing Mg, inclusions having an equivalent circle diameter of 1 μm or more are focused on.

Therefore, in inclusions having an equivalent circle diameter of 1 μm or more and inclusions having an S content of 5 mass % or more, the number of "inclusions having a Mg content of more than 5 mass % and a Mn content of 5 mass % or more" is 5 times or more the number of "inclusions having a Mg content of 5 mass % or less and a Mn content of 5 mass % or more."

Thereby, inclusions are hardened, the inclusions are less likely to become starting points for cracks due to deformation, and fatigue strength is improved. In inclusions having an equivalent circle diameter of 1 μm or more and having an S content of 5 mass % or more contained in base iron, the number of inclusions having a Mg content of more than 5 mass % and a Mn content of 5 mass % or more is preferably 10 times or more the number of inclusions having a Mg content of 5 mass % or less and a Mn content of 5 mass % or more.

Analysis of inclusions is performed by observing a full-sheet thickness region using an SEM. In order to obtain an observable area, the observation surface may be prepared by oblique polishing, or the observation surface may be prepared by laminating a plurality of steel sheets. The steel sheet is cut out and filled with a resin so that a surface including a width direction (direction perpendicular to a rolling direction) and a sheet thickness direction becomes the observation surface. Next, the observation surface of the resin-filled steel sheet is polished. The area to be observed may be changed according to the number of inclusions present, and is 5 $mm^2$ or more. The size of inclusions is determined by measuring the size of inclusions using image analysis software, and by defining the diameter when converted to a circle equivalent. The inclusions can be subjected to element analysis using EDS, and a component is defined by an average value for an entire mass of individual inclusions.

In each field of view, the number of inclusions having an equivalent circle diameter of 1.0 μm or more and an S content of 5 mass % or more detected is determined. Specifically, first, the inclusions in each field of view are identified from the contrast. Among the identified inclusions, inclusions having an equivalent circle diameter of 1.0 μm or more are subjected to element concentration analysis (EDS analysis). All detected elements (excluding C) are quantified, and inclusions having an equivalent circle diameter of 1.0 μm or more and having a Mg content of 5 mass % or less and a Mn content of 5 mass % or more and inclusions having an equivalent circle diameter of 1.0 or more and having a Mg content of more than 5 mass % and a Mn content of 5 mass % or more are identified.

Among the inclusions identified in the observed field of view range with an area of 5 $mm^2$ or more, within inclusions having an equivalent circle diameter of 1.0 μm or more and having an S content of 5 mass % or more and a Mn content of 5 mass % or more, the number of inclusions having a Mg content of 5 mass % or less and the number of inclusions having a Mg content of more than 5 mass % are obtained and a ratio thereof is calculated.

When the number density (pieces/$mm^2$) is obtained based on the total area of the observed field of view, the obtained numerical value is rounded off to the third decimal place. Here, the number density is measured using a device (SEM-EDS device) in which a composition analysis function is imparted to a scanning electron microscope.

In addition, if there are coarse inclusions, the inclusions may become starting points for cracks, and lower the fatigue limit. Therefore, fewer coarse inclusions are preferable. Specifically, the number density of inclusions having an equivalent circle diameter of 5 μm or more is preferably less than 1.0 piece/$mm^2$.

A method for making the number density of inclusions having an equivalent circle diameter of 5 μm or more less than 1.0 piece/$mm^2$ is not particularly limited, and examples thereof include methods in which inclusions float on the surface of molten steel while the molten steel remains in a tundish, in continuous casting, an electromagnetic brake is applied to the molten steel in the mold to lengthen the time during which the molten steel remains in the mold and allow inclusions to float on the surface of the molten steel, or a mold longer in a vertical direction is used to lengthen the time during which the molten steel remains in the mold and allow inclusions to float on the surface of the molten steel, and the floated inclusions are removed later.

In addition, realization of inclusions containing Mg defined in the present invention also contributes to making the number density of inclusions having an equivalent circle diameter of 5 μm or more less than 1.0 piece/$mm^2$. Examples of coarse inclusions having an equivalent circle diameter of 5 μm or more include $Al_2O_3$ and MnS. Between Al and Mg, Mg has a higher deoxidizing power than Al. Therefore, in the present invention that utilizes Mg, $Al_2O_3$ is secondarily reduced in the steelmaking stage and MgO is likely to be produced. If $Al_2O_3$ is used without change, it has a large specific gravity and tends to remain in the molten steel, but MgO has a small specific gravity and easily floats, and thus it is easy to remove. In addition, regarding MnS, Mg is more likely to form sulfides than Mn, and more likely to initiate precipitation at a higher temperature than MnS. Therefore, the amount of MnS precipitated is reduced. Furthermore, MgS, which is uniformly dispersed first, becomes a precipitation site for MnS that precipitates later, and thus the frequency of formation of coarse MnS formed by itself is reduced. Therefore, formation of coarse inclusions can be reduced by controlling Mg inclusions.

In the non-oriented electrical steel sheet according to the present embodiment, the microstructure has almost 100% of ferrite. The remainder of the microstructure is inclusions and the like. Thus, the average grain size of the recrystallization part is 50 μm or less. As the crystal grains coarsen, the strength decreases. Here, the recrystallization part refers to crystal grains (recrystallized grains) having an aspect ratio (length in rolling direction/length in sheet thickness direction) of 3 or less among ferrite grains. On the other hand, non-recrystallized grains have an aspect ratio of more than 3. When the microstructure is observed and the grain size of non-recrystallized grains and recrystallized grains is determined, the following method can be used. A test piece having an observation surface including the rolling direction and the sheet thickness direction of the steel sheet is prepared, and the center part of the sheet thickness is observed. The observation surface of the test piece is polished to a mirror surface, and then immersed in a 3% nital etchant for 10 seconds, and the structure is exposed by etching. The etched observation surface is observed using an optical microscope at a magnification of 500. Crystal grains having an aspect ratio of 3 or less are identified from the observation surface after etching, and the average grain size is calculated therefrom. The average grain size is determined according to JIS G 0551: 2013 "microscopic test method of steel-crystal grain size." The lower limit of the average grain size of the recrystallization part is not particularly limited, but if the crystal grains are excessively refined, and the average grain size is too small, the sheet shape of the steel sheet may deteriorate. Therefore, the average grain size of the recrystallization part is preferably 10 μm or more, more preferably 12 μm or more, and still more preferably 15 μm or more. In addition, the proportion of non-recrystallized grains may be 100%. When no recrystallized grains are observed, the average grain size defined in the present invention is set to 0.

The tensile strength of the non-oriented electrical steel sheet according to the present embodiment is 580 MPa or more. Since the chemical composition for increasing the tensile strength is known, it may be appropriately adjusted. The chemical composition of the non-oriented electrical steel sheet according to the present embodiment can be, for example, a chemical composition to be described below. In addition, in order to obtain a tensile strength of 580 MPa or more, as will be described below, it is necessary to adjust the final annealing temperature.

The tensile strength is measured using JIS Z 2241: 2011 No. 13B tensile test piece.

The chemical composition of the non-oriented electrical steel sheet according to the present embodiment is not particularly limited as long as it can be applied to a non-oriented electrical steel sheet having a tensile strength of 580 MPa or more. Hereinafter, an example of a preferable chemical composition of the non-oriented electrical steel sheet according to the present embodiment will be shown. "%" in the description of the chemical composition is "mass %." The non-oriented electrical steel sheet according to the present embodiment has a chemical composition containing, in mass %, Si: 2.5 to 4.5%, sol. Al: 0 to 2.0%, Mn: 0.1 to 3.5%, C: 0 to 0.0030%, P: 0 to 0.10%, S: 0 to 0.0030%, N: 0 to 0.050%, O: 0 to 0.050%, Mg: 0.0003 to 0.0050%, Ti: 0.0030% or less, V: 0 to 0.10%, Sb: 0 to 0.10%, Nd: 0 to 0.10%, Bi: 0 to 0.10%, W: 0 to 0.10%, Nb: 0 to 0.10%, Y: 0 to 0.10%, and one or more selected from the group consisting of Ni: 0 to 0.5%, Cr: 0 to 0.5%, Cu: 0 to 0.5%, Sn: 0 to 0.2%, La: 0 to 0.0050%, and, Ce: 0 to 0.0050%, with the remainder of Fe and impurities.

Si is an element that increases the strength of the steel sheet. In addition, Si is an element that increases resistivity and is contained in order to reduce iron loss. In consideration of this effect and prevention of a decrease in the saturated magnetic flux density and embrittlement of steel, the Si content is preferably 2.5 to 4.5%. The Si content is preferably 2.8% or more and more preferably 3.0% or more. In addition, the Si content is more preferably 4.2% or less, and still more preferably 4.0% or less.

Like Si, sol. Al is an element that increases resistivity, and is contained in order to reduce iron loss. Since the effect of reducing iron loss is obtained even with Si, sol. Al does not have to be contained. Therefore, the sol. Al content may be 0%. The sol. Al content may be 0.3% or more, 0.4% or more, 0.5% or more, or 0.6% or more. On the other hand, in order to prevent the saturated magnetic flux density from decreasing, the sol. Al content is preferably 2.0% or less. The sol. Al content is more preferably 1.8% or less, and still more preferably 1.5% or less. The sol. Al content may be 1.2% or less. Here, sol. Al means acid-soluble Al that does not become an oxide such as $Al_2O_3$ and is soluble in an acid, and is determined as Al measured after the undissolved residue on the filter paper generated in the Al analysis procedure is removed.

Like Si and sol. Al, since Mn has a function of increasing resistivity, it is contained in order to reduce iron loss. In addition, Mn is an element that increases the strength of the steel sheet. In consideration of this effect and prevention of a decrease in the saturated magnetic flux density and embrittlement of steel, the Mn content is preferably 0.1 to 3.5%. The Mn content is more preferably 0.4% or more, still more preferably 0.6% or more, and yet more preferably 0.8% or more. The Mn content may be 0.9% or more, 1.0% or more, or 1.2% or more. In addition, the Mn content is more preferably 3.3% or less, and still more preferably 3.5% or less. The Mn content may be 3.0% or less.

C is contained as an impurity. In order to reduce iron loss, the C content is preferably 0.0030% or less. The C content is more preferably 0.0025% or less, and still more preferably 0.0020% or less. The lower limit of the C content is not particularly limited and may be 0%, and the C content may be 0.0010% or more in consideration of manufacturing cost.

P is an element that improves the strength of the steel sheet. Since the strength of the steel sheet can be improved with Si and Mn, P does not have to be contained. Therefore, the P content may be 0%. The P content may be 0.01% or more, 0.02% or more, or 0.04% or more. On the other hand, in order to prevent embrittlement of the steel sheet, the P content is preferably 0.10% or less. The P content is more preferably 0.08% or less, and still more preferably 0.06% or less. The P content may be 0.04% or less.

S is contained as an impurity. In order to reduce iron loss, the S content is preferably 0.0030% or less. The S content is more preferably 0.0025% or less, and still more preferably 0.0020% or less. In addition, in order to form inclusions having an S content of 5 mass % or more, the S content of the steel sheet is more than 0%. The S content may be 0.0006% or more, or 0.0007% or more.

N is contained as an impurity. In order to reduce iron loss, the N content is preferably 0.050% or less. If the N content is 0.050% or less, excessive generation of inclusions and precipitates can be reduced and deterioration of magnetic properties and fatigue strength can be further reduced. The N content may be 0.0027% or less, 0.0025% or less, or 0.0020% or less. In addition, since N may not be contained in the non-oriented electrical steel sheet, the lower limit of the N content may be 0%, but in order to reduce an excessive cost increase, the N content is preferably 0.0010% or more. The N content may be 0.0014% or more, 0.0017% or more, or 0.0020% or more.

O is contained as an impurity. In order to reduce iron loss, the O content is preferably 0.050% or less. If the O content is 0.050% or less, excessive generation of inclusions and precipitates can be reduced and deterioration of magnetic properties and fatigue strength can be further reduced. The O content may be 0.0027% or less, 0.0025% or less, or 0.0020% or less. In addition, since 0 may not be contained in the non-oriented electrical steel sheet, the lower limit of the O content may be 0%, but in order to reduce an excessive cost increase, the O content is preferably 0.0010% or more. The O content may be 0.0014% or more, 0.0017% or more, or 0.0020% or more.

Mg is an element that reduces iron loss through a function of promoting growth of crystal grains, and is an element that improves fatigue strength by converting sulfides in inclusions into harder inclusions containing Mg. In order to obtain this effect, in consideration of cost, the Mg content is preferably 0.0003 to 0.0050%. The Mg content is more preferably 0.0005% or more, and still more preferably 0.0010% or more. The Mg content is more preferably 0.0040% or less and still more preferably 0.0030% or less.

Ti is an element contained as an impurity. Ti is combined with C, N, O, or the like in base iron to form fine precipitates such as TiN, TiC, and Ti oxides, which inhibit growth of crystal grains during annealing and deteriorates magnetic properties. Therefore, the Ti content is preferably 0.0030% or less. The Ti content is more preferably 0.0020% or less, and still more preferably 0.0010% or less. Since Ti does not need to be contained, the lower limit of the content is 0%. In consideration of refining cost, the Ti content may be 0.0003% or more or 0.0005% or more.

The remainder of the chemical composition is made up of Fe and impurities. Impurities refer to components that are included in raw materials or components that are mixed in during a manufacturing procedure, and components that are not intentionally included in the steel sheet. Examples of impurities include Zn and B.

In addition, the non-oriented electrical steel sheet according to the present embodiment may contain V: 0 to 0.10%, Zr: 0 to 0.10%, Sb: 0 to 0.10%, Nd: 0 to 0.10%, Bi: 0 to 0.10%, W: 0 to 0.10%, Nb: 0 to 0.10%, Y: 0 to 0.10%, and Ca: 0 to 0.0050%.

V and Nb are elements that contribute to increasing the strength of the non-oriented electrical steel sheet. Since V and Nb may not be contained, the amounts of each of V and Nb may be 0%, but in order to obtain the above effect, and the amounts of each of V and Nb is preferably 0.0010% or more. The amounts of each of V and Nb may be 0.0023% or more. On the other hand, if each element of V and N is excessively contained, since fine precipitates inhibit grain growth and deteriorates iron loss, the amounts of each of V and Nb is preferably 0.10% or less. The amounts of each of V and Nb is preferably 0.0050% or less.

Zr, Nd, Bi, W, and Y are elements that reduce fine precipitates and improve grain growth of crystal grains. As a result, the productivity is improved. Since the above elements may not be contained, the amounts of each of Zr, Nd, Bi, W, and Y may be 0%, and in order to obtain the above effect, the amounts of each of Zr, Nd, Bi, W, and Y is preferably 0.0010% or more. The amounts of each of Zr, Nd, Bi, W, and Y is more preferably 0.0015% or more. On the other hand, even if each element of Zr, Nd, Bi, W, and Y is excessively contained, since the above effect is maximized, the amounts of each of Zr, Nd, Bi, W, and Y is preferably 0.10% or less. The amounts of each of Zr, Nd, Bi, W, and Y is preferably 0.0010% or less.

Sb is an element that improves magnetic properties, for example, B50. Since Sb may not be contained, the Sb content may be 0%, in order to obtain the above effect, the Sb content is preferably 0.0050% or more. The Sb content is more preferably 0.01% or more. On the other hand, even if Sb is excessively contained, since the above effect is maximized, the Sb content is preferably 0.10% or less. The Sb content is preferably 0.05% or less.

In addition, in addition to the above elements, the steel sheet may contain one or more elements selected from the group consisting of Ni, Cr, Cu, Sn, La, and Ce in place of some Fe.

Ni is an element that increases the electrical resistance of a steel sheet and reduces iron loss. It is not necessary to contain Ni, and the lower limit of the Ni content is 0%. Although the Ni inclusion effect is obtained even if the amount is very small, in order to reliably obtain the inclusion effect, the Ni content is preferably 0.01% or more and more preferably 0.02% or more. In consideration of production cost, the Ni content is preferably 0.5% or less and more preferably 0.4% or less.

Cr is an element that improves corrosion resistance and high frequency characteristics. It is not necessary to contain Cr, and the lower limit of the Cr content is 0%. Although the Cr inclusion effect is obtained even if the amount is very small, in order to reliably obtain the inclusion effect, the Cr content is preferably 0.01% or more and more preferably 0.02% or more. In consideration of production cost, the Cr content is preferably 0.5% or less and more preferably 0.4% or less.

Cu is an element that increases the electrical resistance of a steel sheet and reduces iron loss. It is not necessary to contain Cu, and the lower limit of the Cu content is 0%. Although the Cu inclusion effect is obtained even if the amount is very small, in order to reliably obtain the inclusion effect, the Cu content is preferably 0.01% or more and more preferably 0.02% or more. In consideration of production cost, in order to prevent embrittlement of steel, the Cu content is preferably 0.5% or less and more preferably 0.4% or less.

Sn is an element that exhibits preferable crystal orientation for magnetic properties. It is not necessary to contain Sn, and the lower limit of the Sn content is 0%. Although the Sn inclusion effect is obtained even if the amount is very small, in order to reliably obtain the inclusion effect, the content is preferably 0.01% or more and more preferably 0.02% or more. In order to prevent magnetic properties from deteriorating, the Sn content is preferably 0.2% or less and more preferably 0.1% or less.

La is an element that coarsens sulfides, improves growth of crystal grains in the heat treatment step, and contributes to decreasing the iron loss. It is not necessary to contain La, and the lower limit of the La content is 0%. Although the La inclusion effect is obtained even if the amount is very small, in order to reliably obtain the inclusion effect, the La content is preferably 0.005% or more and more preferably 0.0010% or more. In order to prevent magnetic properties from deteriorating, the La content is preferably 0.0050% or less and more preferably 0.0030% or less.

Ce is an element that coarsens sulfides, improves growth of crystal grains in the heat treatment step, and contributes to decreasing the iron loss. It is not necessary to contain Ce, and the lower limit of the Cu content is 0%. Although the Ce inclusion effect is obtained even if the amount is very small, in order to reliably obtain the inclusion effect, the Ce content is preferably 0.005% or more and more preferably 0.0010% or more. In order to prevent magnetic properties from deteriorating, the Ce content is preferably 0.0050% or less and more preferably 0.0030% or less.

In addition, in addition to the above elements, instead of Fe, one or more elements selected from the group consisting of As, Ga, Ge, Se, Co, and Pb may be contained in a range of 0 to 0.01%.

The sheet thickness of the non-oriented electrical steel sheet according to the present embodiment is preferably less than 0.30 mm. If the sheet thickness is less than 0.30 mm, deterioration of magnetic properties is reduced.

Next, a method for manufacturing a non-oriented electrical steel sheet according to an embodiment of the present invention will be described.

First, a steel slab having a predetermined chemical composition is manufactured. The slab is first melted in a converter, an electric furnace or the like, and additionally, subjected to a vacuum degassing treatment as necessary to obtain molten steel. Then, the obtained molten steel is continuously cast or slabbed after ingot making to form a slab having a thickness of about 30 to 400 mm. In this case, a cooling rate at 1,300° C. to 1,200° C. is set to 50° C./s or slower. If the cooling rate is too fast, MgS is not manufactured preferentially over MnS, and the number of inclusions having a Mg content of more than 5 mass % and a Mn content of 5 mass % or more decreases, and as a result, the fatigue strength of the non-oriented electrical steel sheet decreases. The thickness of the steel slab may be 150 mm or more. In addition, the thickness of the steel slab may be 350 mm or less.

After the steel slab is manufactured, the steel slab is heated again, and hot-rolled to obtain a hot-rolled steel sheet. In this case, in the heating of the steel slab, the holding time at which the center temperature is 1,100° C. or higher is shorter than 2 hours (excluding 0). If the holding time is too long, the amount of sulfides with a low Mg content increases, and as a result, the fatigue strength of the non-oriented electrical steel sheet decreases. Hot rolling conditions are not particularly limited. For example, the final rolling temperature during final rolling may be 700 to 1,050° C.

After hot rolling, coiling, hot-band annealing, and cold rolling are performed. The coiling temperature during hot rolling is 700° C. or higher. The coiling temperature during hot rolling is, for example, 700 to 1,000° C. if the coiling temperature is lower than 700° C., this is not preferable because S alone in a solid solution state at this time forms MnS and MnS that does not contain Mg is likely to be formed. Other conditions are not particularly limited. Hot-band annealing may be omitted. Hot-band annealing can be performed by, for example, continuous annealing at 950° C. or higher and 1,050° C. or lower for 10 seconds or longer and 3 minutes or shorter. Cold rolling can be performed, for example, in a temperature range of room temperature to 300° C. at a rolling reduction rate of 70 to 90%.

After cold rolling is performed to obtain a cold-rolled steel sheet, the steel sheet is subjected to final annealing to obtain a non-oriented electrical steel sheet. In order to obtain a non-oriented electrical steel sheet having high tensile strength and excellent fatigue strength, final annealing is performed at a low temperature. Specifically, final annealing is performed with a maximum temperature of 700 to 900° C. and a soaking time of, for example, 10 to 60 seconds. Here, the soaking time is a time during which the maximum temperature reached −10° C. A more optimal maximum temperature may be appropriately adjusted according to the chemical component. According to final annealing at a low temperature, the growth of crystal grains is inhibited, the average grain size of the recrystallization part is 50 μm or less, and a non-oriented electrical steel sheet having high tensile strength and excellent fatigue strength can be obtained.

The non-oriented electrical steel sheet manufactured as described above has excellent fatigue strength with a high tensile strength of 580 MPa or more.

The fatigue strength can be obtained by a pulsating tensile test according to JIS Z 2273: 2011. Specifically, a fatigue test piece in which the rolling direction and the tensile direction are matched is taken from the non-oriented electrical steel sheet. A JIS 2-15 test piece is used as the test piece shape. End surfaces of a parallel portion and an R portion are polished with 600 abrasive paper, and a pulsating tensile test is then performed at room temperature in an atmospheric atmosphere. The maximum stress at which breakage did not occur after 2 million cycles of repeated stress loads at a stress ratio of 0.10 and a frequency of 20 Hz is used as the fatigue strength (MPa). In the present invention, if the fatigue strength is 450 MPa or more, it is determined that fatigue strength is excellent.

Examples of preferable embodiments of the present invention have been described, but the present invention is not limited to the above examples. The above embodiments are only examples, and any embodiment that has substantially the same configuration as the technical idea described in the claims of the present invention and exhibits the same operations and effects is included in the technical scope of the present invention. For example, a method for manufacturing a non-oriented electrical steel sheet according to the present embodiment may include other known manufacturing steps.

EXAMPLES

Hereinafter, the present invention will be described in detail with reference to examples, but the present invention is not limited thereto. It can be clearly understood that those skilled in the art can realize various modification examples and alternations within the scope of ideas described in the scope of the claims, and these are naturally also included in the technical scope of the present invention.

Example 1

A steel type (Mg-free) having a chemical composition containing Si: 3.3%, sol. Al: 0.7%, Mn: 1.2%, C: 0.002%, P: 0.02%, S: 0.0010%, and Ti: 0.0015%, with the remainder of Fe and impurities, and a steel type (Mg added) containing Mg: 0.0013% in place of a part of Fe in the steel type were used to prepare an electrical steel sheet, and the tensile strength and the fatigue strength were measured by the above method.

In the manufacture of electrical steel sheets, the cooling rate of 1,300° C. to 1,200° C. in casting was 30° C./s, the holding time at a center temperature of 1,100° C. or higher in heating the steel slab before hot rolling was 1 hour, the coiling temperature was 750° C., and the final annealing temperature was changed between 750 and 1,000° C.

Table 1 shows the tensile strength and fatigue strength of the electrical steel sheets with different final annealing temperatures and with and without Mg. In this test, a tensile strength of 580 MPa or more and a fatigue strength of 450 MPa or more were determined to be satisfactory. In the Mg-added electrical steel sheet having the above chemical component, favorable results were obtained when the final annealing temperature was set to 750 to 800° C.

TABLE 1

| Final annealing temperature | Mg added | | Without Mg | |
|---|---|---|---|---|
| (° C.) | TS (MPa) | $\sigma_{max}$ (MPa) | TS (MPa) | $\sigma_{max}$ (MPa) |
| 750 | 631 | 510 | 624 | 470 |
| 800 | 620 | 500 | 618 | 460 |
| 850 | 589 | 460 | 587 | 440 |
| 900 | 573 | 440 | 570 | 420 |
| 950 | 558 | 420 | 555 | 410 |
| 1000 | 541 | 410 | 539 | 400 |

Example 2

Using non-oriented electrical steel sheets having components shown in Tables 2A and 2B, under conditions of a cooling rate during casting, a holding time in a heating furnace before hot rolling at 1,100° C. or higher, a coiling temperature, and the maximum temperature during final annealing shown in Table 3A, non-oriented electrical steel sheets having a sheet thickness shown in Table 3A were manufactured.

In the manufactured non-oriented electrical steel sheet, the number of "inclusions having a Mg content of 5 mass % or less and a Mn content of 5% or more" per 1 $mm^2$, the number of "inclusions having a Mg content of more than 5% and a Mn content of 5% or more" per 1 $mm^2$, the average grain size of the recrystallization part, the tensile strength, and the fatigue strength were measured by the above methods.

[Microstructure Observation Test]

The microstructure of the steel sheet of each test number was observed by the following method, and the grain size of the recrystallization part of the ferrite structure was obtained. A test piece including a surface including a rolling direction and a sheet thickness direction of each steel sheet was prepared, the observation surface of the test piece was polished to a mirror surface, and then immersed with a 3% nital etchant for 10 seconds, and the structure was exposed by etching. The etched observation surface was observed using an optical microscope at a magnification of 100 in 3 fields of view. A region in which the aspect ratio (length in rolling direction/length in sheet thickness direction) of ferrite grains was 3 or less was identified, and the average grain size of ferrite in that region was determined according to JIS G 0551: 2013 "microscopic test method of steel-crystal grain size."

[Number Density Measurement Test for Inclusion]

8 steel sheets having a sheet thickness of 0.25 mm were superimposed, and a test piece was filled with a resin so that a surface including a width direction (direction perpendicular to a rolling direction) and a sheet thickness direction became the observation surface, and the observation surface of the resin-filled test piece was polished. The superimposed full-sheet thickness region was observed using an SEM with EDS. The size of inclusions was measured using image analysis software, and the diameter when converted to an equivalent circle diameter was calculated. In a range of $mm^2$, all inclusions having an equivalent circle diameter of 1 μm or more were observed. Then, inclusions of 1 μm or more were subjected to EDS analysis, among inclusions having a "S content of 5 mass % or more" and a "Mn content of 5 mass % or more," the number density of inclusions having a "Mg content of 5 mass % or less and more than 5 mass %" was measured. When the number density (pieces/$mm^2$) was obtained based on the total area, the obtained numerical value was rounded off to the third decimal place, and used as the number density of inclusions having an equivalent circle diameter of 1 μm or more. Inclusions having an equivalent circle diameter of more than 5 μm were determined only by their size regardless of components, and similarly, the number density was measured based on the total area. In this case, since there was no need to calculate the ratio, the number density was obtained by performing rounding off to the second decimal place.

[Magnetic Properties]

The iron loss $W_{10/400}$ of the non-oriented electrical steel sheet at a frequency of 400 Hz and a magnetic flux density of 1.0 T was obtained by an excitation current method according to a method for measuring magnetic properties of electromagnetic steel strips using an Epstein tester described in JIS C 2550-1: 2011.

The results are shown in Table 3B. In Table 3B, "Mg: 5% or less" means the number of "inclusions having a Mg content of 5 mass % or less and a Mn content of 5% or more" per 1 $mm^2$, "Mg: more than 5%" means the number of "inclusions having a Mg content of more than 5% and a Mn content of 5% or more" per 1 $mm^2$, and the ratio is a ratio of the number of "inclusions having a Mg content of more than 5% and a Mn content of 5% or more" to the number of "inclusions having a Mg content of 5 mass % or less and a Mn content of 5% or more." In addition, in Table 3, "5 μm or more" indicates the number density (pieces/$mm^2$) of inclusions having an equivalent circle diameter of 5 μm or more.

TABLE 2A

| | | Chemical composition (mass%, remainder of Fe and impurities) | | | | | | | | | | | | |
|---|---|---|---|---|---|---|---|---|---|---|---|---|---|---|
| Test No. | Steel type | Si | sol. Al | Mn | C | P | S | N | O | Mg | Ti | V | Zr | Sb |
| 1 | A | 3.4 | 0.3 | 0.9 | 0.0021 | 0.01 | 0.0011 | 0.0026 | 0.0015 | 0.0007 | 0.0013 | — | — | — |
| 2 | B | 2.6 | 1.3 | 1.5 | 0.0026 | 0.04 | 0.0021 | 0.0022 | 0.0028 | 0.0004 | 0.0007 | — | — | — |
| 3 | C | 3.7 | 0.3 | 1.0 | 0.0029 | 0.01 | 0.0006 | 0.0024 | 0.0020 | 0.0003 | 0.0011 | — | — | — |
| 4 | D | 3.2 | 0.4 | 0.5 | 0.0022 | 0.01 | 0.0014 | 0.0022 | 0.0026 | 0.0001 | 0.0014 | — | — | — |
| 5 | E | 2.4 | 1.2 | 0.7 | 0.0022 | 0.08 | 0.0013 | 0.0023 | 0.0026 | 0.0010 | 0.0008 | — | — | — |
| 6 | F | 3.5 | 0.2 | 0.4 | 0.0027 | 0.06 | 0.0007 | 0.0017 | 0.0014 | 0.0008 | 0.0018 | — | — | — |
| 7 | G | 3.2 | 1.2 | 0.6 | 0.0016 | 0.01 | 0.0015 | 0.0014 | 0.0011 | 0.0006 | 0.0009 | — | — | — |
| 8 | H | 4.1 | 0.3 | 0.4 | 0.0018 | 0.01 | 0.0018 | 0.0024 | 0.0016 | 0.0034 | 0.0022 | — | — | — |
| 9 | 1 | 3.1 | 0.4 | 3.0 | 0.0022 | 0.01 | 0.0023 | 0.0019 | 0.0014 | 0.0021 | 0.0027 | — | — | — |
| 10 | J | 2.8 | 1.8 | 1.2 | 0.0026 | 0.01 | 0.0014 | 0.0021 | 0.0019 | 0.0014 | 0.0012 | — | — | — |
| 11 | K | 3.1 | 1.2 | 0.4 | 0.0018 | 0.02 | 0.0013 | 0.0017 | 0.0025 | 0.0011 | 0.0024 | — | — | — |
| 12 | L | 3.3 | 0.5 | 0.5 | 0.0024 | 0.01 | 0.0021 | 0.0022 | 0.0017 | 0.0013 | 0.0011 | — | — | — |
| 13 | M | 3.5 | 0.3 | 0.6 | 0.0015 | 0.01 | 0.0009 | 0.0027 | 0.0013 | 0.0011 | 0.0007 | — | — | — |
| 14 | N | 3.5 | 0.5 | 0.6 | 0.0017 | 0.01 | 0.0007 | 0.0021 | 0.0020 | 0.0023 | 0.0016 | — | — | — |
| 15 | O | 3.2 | 0.3 | 0.9 | 0.0014 | 0.01 | 0.0011 | 0.0018 | 0.0027 | 0.0025 | 0.0019 | — | — | — |
| 16 | P | 3.3 | 0.7 | 0.9 | 0.0018 | 0.01 | 0.0017 | 0.0011 | 0.0022 | 0.0016 | 0.0006 | 0.0019 | — | — |
| 17 | Q | 3.5 | 0.3 | 0.2 | 0.0022 | 0.01 | 0.0011 | 0.0014 | 0.0024 | 0.0023 | 0.0011 | — | — | — |
| 18 | R | 3.2 | 0.6 | 0.4 | 0.0026 | 0.01 | 0.0008 | 0.0023 | 0.0015 | 0.0016 | 0.0013 | — | — | — |
| 19 | S | 2.9 | 0.4 | 1.7 | 0.0011 | 0.02 | 0.0021 | 0.0016 | 0.0022 | 0.0017 | 0.0021 | — | — | 0.0050 |
| 20 | T | 3.8 | 0.6 | 0.3 | 0.0024 | 0.01 | 0.0016 | 0.0017 | 0.0026 | 0.0016 | 0.0023 | — | — | — |
| 21 | U | 3.1 | 0.2 | 0.2 | 0.0022 | 0.05 | 0.0028 | 0.0027 | 0.0028 | 0.0002 | 0.0029 | — | — | — |
| 22 | V | 3.6 | 0.4 | 1.2 | 0.0017 | 0.01 | 0.0022 | 0.0015 | 0.0018 | 0.0016 | 0.0012 | — | — | — |
| 23 | W | 3.7 | 0.9 | 0.1 | 0.0025 | 0.01 | 0.0027 | 0.0021 | 0.0018 | 0.0031 | 0.0011 | — | 0.0023 | |

"—" indicates that the component was not intentionally added

TABLE 2B

| Test No. | Steel type | Chemical composition (mass %, remainder Fe and impurities) | | | | | | | | | | | |
|---|---|---|---|---|---|---|---|---|---|---|---|---|---|
| | | Nd | Bi | W | Nb | Y | Ni | Cr | Cu | Sn | La | Ce | Zn |
| 1 | A | — | — | — | — | — | — | 0.05 | — | — | — | — | — |
| 2 | B | — | — | — | — | — | — | — | — | 0.03 | — | — | — |
| 3 | C | — | — | — | — | — | 0.04 | — | — | — | — | — | — |
| 4 | D | — | — | — | — | — | — | — | 0.06 | — | — | — | — |
| 5 | E | — | — | — | — | — | — | — | — | — | — | — | — |
| 6 | F | — | — | — | — | — | — | 0.07 | — | — | — | — | — |
| 7 | G | — | — | — | — | — | — | — | — | — | — | — | — |
| 8 | H | — | — | — | — | — | 0.07 | — | — | — | — | — | — |
| 9 | I | — | — | — | — | — | — | — | — | — | — | — | — |
| 10 | J | — | — | — | — | — | — | — | 0.04 | — | — | — | — |
| 11 | K | — | — | — | — | — | — | — | — | — | — | — | — |
| 12 | L | — | — | — | — | — | — | — | — | — | — | — | — |
| 13 | M | — | — | — | — | — | — | — | — | — | — | — | — |
| 14 | N | — | — | — | — | — | — | — | — | 0.02 | 0.0010 | 0.0020 | — |
| 15 | O | — | — | — | — | — | 0.05 | 0.05 | — | — | — | — | — |
| 16 | P | — | — | 0.0011 | 0.0016 | — | — | — | — | — | — | — | — |
| 17 | Q | 0.0010 | — | — | — | 0.0011 | — | — | — | — | 0.0020 | 0.0010 | — |
| 18 | R | — | — | — | — | — | — | — | — | — | — | — | — |
| 19 | S | — | 0.0012 | — | — | — | — | — | — | 0.01 | — | — | — |
| 20 | T | — | — | — | — | — | — | — | — | — | — | — | 0.0013 |
| 21 | U | — | — | — | — | — | — | — | — | — | — | — | — |
| 22 | V | — | — | — | — | — | — | — | — | — | — | — | — |
| 23 | W | — | — | — | — | — | — | — | — | — | — | — | — |

"—" indicates that the component was not intentionally added

TABLE 3A

| Test No. | Steel type | Slab thickness (mm) | Cooling rate at 1,300° C. to 1,200° C. in casting (° C./s) | Holding time at a center temperature of 1,100° C. or higher in heating of slab (hours) | Coiling temperature (° C.) | Maximum temperature during final annealing (° C.) | Sheet thickness (mm) |
|---|---|---|---|---|---|---|---|
| 1 | A | 250 | 30 | 1 | 720 | 810 | 0.25 |
| 2 | B | 250 | 30 | 1 | 720 | 840 | 0.25 |
| 3 | C | 250 | 30 | 1 | 720 | 890 | 0.25 |
| 4 | D | 250 | 30 | 1 | 720 | 760 | 0.25 |
| 5 | E | 250 | 30 | 1 | 720 | 800 | 0.25 |
| 6 | F | 250 | 30 | 1 | 900 | 810 | 0.25 |
| 7 | G | 250 | 30 | 1 | 720 | 880 | 0.25 |
| 8 | H | 250 | 30 | 1 | 720 | 890 | 0.25 |
| 9 | I | 350 | 30 | 1 | 720 | 860 | 0.25 |
| 10 | J | 150 | 30 | 1 | 720 | 850 | 0.25 |
| 11 | K | 250 | 60 | 1 | 720 | 820 | 0.25 |
| 12 | L | 250 | 30 | 3 | 720 | 800 | 0.25 |
| 13 | M | 250 | 30 | 1 | 720 | 950 | 0.25 |
| 14 | N | 250 | 30 | 1 | 720 | 850 | 0.25 |
| 15 | O | 250 | 30 | 1 | 720 | 740 | 0.25 |
| 16 | P | 250 | 1 | 1 | 720 | 840 | 0.25 |
| 17 | Q | 250 | 50 | 1 | 720 | 850 | 0.25 |
| 18 | R | 250 | 1 | 1 | 680 | 810 | 0.25 |
| 19 | S | 250 | 1 | 1 | 720 | 710 | 0.25 |
| 20 | T | 250 | 0.5 | 1 | 720 | 880 | 0.25 |
| 21 | U | 250 | 1 | 1 | 720 | 730 | 0.30 |
| 22 | V | 250 | 1 | 1 | 720 | 690 | 0.25 |
| 23 | W | 250 | 1 | 1 | 720 | 890 | 0.25 |

Underlines indicate outside of the scope of the prevent invention or that desired properties were not obtained.

TABLE 3B

| Test No. | Steel type | Mg: 5% or less (pieces/mm$^2$) | Mg: more than 5% (pieces/mm$^2$) | Ratio | 5 μm or more (pieces/mm$^2$) | Average crystal grain diameter of recrystallization part of base iron (μm) | Tensile strength (MPa) | Fatigue strength (MPa) | W10/400 (W/kg) | Note |
|---|---|---|---|---|---|---|---|---|---|---|
| 1 | A | 0.04 | 0.77 | 19.3 | 0.7 | 18 | 608 | 480 | 16.2 | Example of present invention |
| 2 | B | 0.13 | 0.84 | 6.5 | 0.7 | 21 | 583 | 460 | 15.4 | Example of present invention |
| 3 | C | 0.04 | 0.22 | 5.5 | 0.9 | 36 | 614 | 470 | 13.6 | Example of present invention |
| 4 | D | 0.35 | 0.14 | 0.4 | 1.1 | 12 | 605 | 440 | 18.2 | Comparative Example |
| 5 | E | 0.30 | 1.30 | 4.3 | 0.6 | 17 | 561 | 440 | 16.7 | Comparative Example |
| 6 | F | 0.02 | 0.56 | 28.0 | 0.7 | 19 | 616 | 490 | 16.2 | Example of present invention |
| 7 | G | 0.06 | 0.90 | 15.0 | 0.7 | 31 | 600 | 460 | 14.0 | Example of present invention |
| 8 | H | 0.01 | 2.10 | 210.0 | 0.3 | 45 | 639 | 490 | 12.9 | Example of present invention |
| 9 | I | 0.03 | 1.82 | 60.7 | 0.4 | 27 | 605 | 470 | 14.1 | Example of present invention |
| 10 | J | 0.03 | 1.21 | 40.3 | 0.5 | 26 | 605 | 470 | 14.3 | Example of present invention |
| 11 | K | 0.15 | 0.43 | 2.9 | 0.3 | 20 | 606 | 440 | 15.7 | Comparative Example |
| 12 | L | 0.22 | 0.84 | 3.8 | 0.5 | 16 | 604 | 440 | 16.8 | Comparative Example |
| 13 | M | 0.02 | 0.99 | 49.5 | 0.6 | 60 | 567 | 420 | 12.7 | Comparative Example |
| 14 | N | 0.01 | 1.24 | 124.0 | 0.4 | 27 | 605 | 470 | 14.7 | Example of present invention |
| 15 | 0 | 0.01 | 1.82 | 182.0 | 0.4 | 13 | 603 | 490 | 17.7 | Example of present invention |
| 16 | P | 0.03 | 2.72 | 90.7 | 0.5 | 26 | 594 | 470 | 14.8 | Example of present invention |
| 17 | Q | 0.01 | 1.78 | 178.0 | 0.4 | 23 | 593 | 470 | 15.6 | Example of present invention |
| 18 | R | 0.41 | 1.28 | 3.1 | 0.4 | 19 | 588 | 440 | 16.2 | Comparative Example |
| 19 | S | 0.03 | 3.57 | 119.0 | 0.5 | 13 | 595 | 480 | 17.6 | Example of present invention |
| 20 | T | 0.03 | 2.56 | 85.3 | 0.4 | 32 | 630 | 490 | 14.0 | Example of present invention |
| 21 | U | 0.05 | 3.92 | 78.4 | 1.0 | 12 | 589 | 430 | 20.1 | Comparative Example |
| 22 | V | 0.03 | 3.52 | 117.3 | 0.8 | 9 | 682 | 550 | 20.1 | Example of present invention |
| 23 | W | 0.02 | 2.15 | 107.5 | 0.4 | 38 | 623 | 480 | 13.4 | Example of present invention |

Underlines indicate outside of the scope of the prevent invention or that desired properties were not obtained.

According to the present invention, it was confirmed that a non-oriented electrical steel sheet having a tensile strength of 580 MPa or more and a fatigue strength of 450 MPa or more was obtained.

What is claimed is:

1. A non-oriented electrical steel sheet having a chemical composition containing, in mass %, Si: 2.5 to 4.5%,
sol. Al: 0 to 2.0%,
Mn: 0.1 to 3.5%,
C: 0 to 0.0030%,
P: 0 to 0.10%,
S: 0 to 0.0030%,
N: 0 to 0.050%, O: 0 to 0.050%,
Mg: 0.0003 to 0.0050%,
Ti: 0 to 0.0030%,
V: 0 to 0.10%,
Sb: 0 to 0.10%,
Nd: 0 to 0.10%,
Bi: 0 to 0.10%,
W: 0 to 0.10%,
Nb: 0 to 0.10%,
Y: 0 to 0.10%, and, one or more selected from the group consisting of Ni: 0 to 0.5%,
Cr: 0 to 0.5%,
Cu: 0 to 0.5%,
Sn: 0 to 0.2%,
La: 0 to 0.0050%, and
Ce: 0 to 0.0050%, with the remainder of Fe and impurities, wherein a tensile strength is 580 MPa or more, an average grain size of a recrystallization part of base iron is 50 μm or less, in inclusions having an equivalent circle diameter of 1 μm or more and having an S content of 5 mass % or more contained in base iron, the number of inclusions having a Mg content of more than 5 mass % and a Mn content of 5 mass % or more is 5 times or more the number of inclusions having a Mg content of 5 mass % or less and a Mn content of 5 mass % or more, in inclusions having an equivalent circle diameter of 1 μm or more and having an S content of 5 mass % or more contained in base iron, the number of inclusions having a Mg content of 5 mass % or less and a Mn content of 5 mass % or more is 0.01 piece/mm$^2$ or more, and a fatigue strength is 450 MPa or more.

2. The non-oriented electrical steel sheet according to claim 1, wherein the number density of inclusions having an equivalent circle diameter of 5 μm or more is less than 1.0 piece/mm$^2$.

3. The non-oriented electrical steel sheet according to claim 2, wherein the number density of inclusions having an equivalent circle diameter of 5 μm or more is 0.3 piece/mm$^2$ or more and less than 1.0 piece/mm$^2$.

4. The non-oriented electrical steel sheet according to claim 1, wherein the sheet thickness is less than 0.30 mm.

5. The non-oriented electrical steel sheet according to claim 1, wherein the chemical composition contains S: 0.0006 to 0.0030%.

6. The non-oriented electrical steel sheet according to claim 1, wherein the number density of inclusions having an equivalent circle diameter of 5 μm or more is 0.3 piece/mm$^2$ or more.

7. A method for manufacturing the non-oriented electrical steel sheet according to claim 1, comprising:

manufacturing a steel slab by casting;

heating the steel slab;

hot rolling the heated steel slab to obtain a hot-rolled steel sheet;

coiling the hot-rolled steel sheet;

cold rolling the hot-rolled steel sheet to obtain a cold-rolled steel sheet; and final annealing the cold-rolled steel sheet to obtain a non-oriented electrical steel sheet, wherein, in the casting, a cooling rate at 1,300° C. to 1,200° C. is set to 50° C./s or slower, in the heating of the steel slab, a holding time at a center temperature of 1,100° C. or higher is set to be shorter than 2 hours (excluding 0), in the coiling, a coiling temperature of the hot-rolled steel sheet is set to 700° C. or higher, and in the final annealing, the maximum temperature is set to 700 to 900° C.

* * * * *